United States Patent [19]

Sekine et al.

[11] Patent Number: 4,762,818

[45] Date of Patent: Aug. 9, 1988

[54] REVERSIBLE IMAGE-FORMING MATERIAL

[75] Inventors: Mikiya Sekine, Warabi; Toshihiko Matsushita, Tokyo; Sadao Morishita, Inashiki; Yasuhiko Oiri, Tokyo, all of Japan

[73] Assignees: Mitsubishi Paper Mills, Ltd.; Nippon Hoso Kyokai, both of Tokyo, Japan

[21] Appl. No.: 860,311

[22] Filed: May 6, 1986

Related U.S. Application Data

[63] Continuation of Ser. No. 711,837, Mar. 14, 1985.

[30] Foreign Application Priority Data

Mar. 15, 1984 [JP] Japan ..... 59-50069
Jun. 1, 1984 [JP] Japan ..... 59-112261
Jun. 4, 1984 [JP] Japan ..... 59-115233

[51] Int. Cl.[4] ..... B41M 5/18

[52] U.S. Cl. ..... 503/214; 427/151; 427/152; 503/200; 503/207; 503/217; 503/221; 503/225; 503/226

[58] Field of Search ..... 346/200, 202, 204, 207, 346/214, 216, 217, 221, 225, 226, ; 427/150–152; 503/200, 202, 204, 207, 214, 216, 217, 221, 225, 226

[56] References Cited

U.S. PATENT DOCUMENTS 4,423,116 12/1983 Fox ..... 427/151
4,535,348 8/1985 Iwakura et al. ..... 346/221

FOREIGN PATENT DOCUMENTS 0158234 12/1979 Japan ..... 346/200

*Primary Examiner*—Bruce H. Hess
*Attorney, Agent, or Firm*—Cushman, Darby & Cushman

[57] ABSTRACT

Reversible image-forming materials on which images are formed by a thermal head and conversely the formed images are erasable by water or moisture are obtained by providing, on one surface of a support, a recording layer comprising a specific fluorane type color former, a color developer and a binder and further providing an overcoat layer on the recording layer. By providing further a sticking prevention layer on the overcoat layer, sticking can be prevented and high speed printing is enabled.

15 Claims, No Drawings

REVERSIBLE IMAGE-FORMING MATERIAL

This is a continuation of application Ser. No. 711,837, filed Mar. 14, 1985.

BACKGROUND OF THE INVENTION

1. Field of the Invention

The present invention relates to a image-forming material. More particularly, the present invention relates to a image-forming material in which images are formed by a thermal head and the formed images are conversely erasable by water or moisture.

2. Description of the Prior Art

Conventional, reversible image-forming materials are disclosed in U.S. Pat. Nos. 3,414,423, 3,515,568, 3,560,229, 3,666,525, 4,028,118 and 3,244,548 as well as Published Unexamined Japanese Patent Application KOKAI No. 191190/83.

Images formed by the method disclosed in U.S. Pat. No. 4,028,118 are irrelevant to fixed images because these images change depending upon temperature.

According to the method described in U.S. Pat. No. 3,560,229, development of color formed by a color forming composition, erasure and/or permanent fixation can be controlled in the presence of heat or water by incorporating specific organic solvents in the composition (column 1, lines 64 to 68). The organic solvents used in this method are glycols, glycol ethers, halogenated biphenyls or biphenyl ethers, aromatic or aliphatic ester type plasticizers and other solvents having a low vapor pressure.

A heat-sensitive copying sheet comprising crystal violet lactone, gallic acid, acetanilide, styrene-butadiene copolymer and toluene is disclosed in U.S. Pat. No. 3,666,525 (column 8, lines 52 to 61). Images formed on this sheet are erased upon contact with water and this heat-sensitive composition requires the addition of a substance that melts upon heating.

U.S. Pat. Nos. 3,414,423 and 3,515,568 are directed to methods for re-use of heat-sensitive copying materials by erasing images formed on the materials. According to these methods, colored complexes of p-quinone compounds and dihydrobenzene compounds are disclosed upon application of certain organic solvents or heat.

Multi-layered sheets using co-reactants of lactone color forming compounds and phloroglucinol are disclosed in U.S. Pat. No. 3,244,548.

Published Unexamined Japanese Patent Application KOKAI No. 191190/83 relates to a reversible heat-sensitive transparent film, in which images formed thereon are blue, green, red, orange and yellow. With the reversible heat-sensitive transparent film, printing at a low speed with a thermal head results in printed images on the recording material but high speed printing causes irregular printing, missing or incompleteness in images, etc., further resulting in running failure of a thermal head. It is considered to be because the temperature of a recording layer coated on a support must be elevated for a short period of time in high speed printing and as a result, the temperature of the thermal head exceeds a melting point of an overcoat layer, for example, a polystyrene resin layer to cause a so-called sticking phenomenon of adhering the overcoat layer to the surface of the thermal head.

SUMMARY OF THE INVENTION

As a result of extensive investigations with an attempt to obtain reversible image-forming materials capable of repeatedly forming images using a thermal head, the present inventors have found that by providing on one surface of a support a recording layer comprising at least one color former selected from the group consisting of a fluorane compound represented by general formula (I):

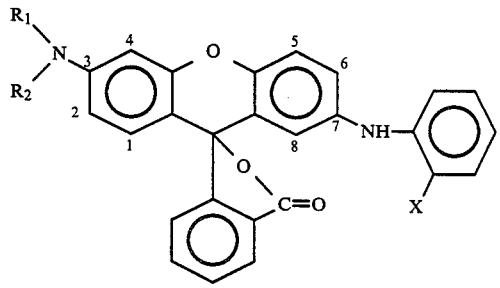

(I)

wherein $R_1$ and $R_2$ each represents an alkyl group and X represents a halogen atom, and a fluorane compound represented by general formula (II):

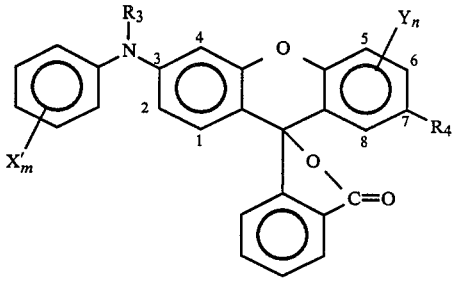

(II)

wherein $R_3$ represents a lower aliphatic alkyl group having 1 to 4 carbon atoms; $R_4$ represents a hydrogen atom, a methyl group, methoxy group choloro an amino group (represented by formula:

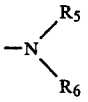

wherein $R_5$ and $R_6$ each represents a hydrogen atom, a lower aliphatic alkyl group having 1 to 4 carbon atoms, a lower aliphatic acyl group having 1 to 4 carbon atoms, a benzoyl group, a phenyl group and a benzyl group; and the benzene rings of these substituents may further be substituted with a halogen atom, a nitro group, a lower alkaphatic alkyl group having 1 to 4 carbon atoms and a lower aliphatic alkoxy group having 1 to 2 carbon atoms) and an alicyclic amino group (represented by formula:

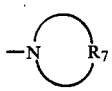

wherein $R_7$ represents a butylene group $-(CH_2)_4-$, a pentylene group $-(CH_2)_5-$ or a diethylene ether group —$(CH_2)_2$—O—$(CH_2$—); X' represents a hydrogen atom, a lower aliphatic alkyl group having 1 to 4 carbon atoms, a halogen atom or a lower aliphatic alkoxy group having 1 to 4 carbon atoms; m represents an integer of 1 or 2; Y represents a lower aliphatic alkyl group having 1 to 4 carbon atoms, a lower aliphatic alkoxy group having 1 to 2 carbon atoms, and a halogen atom; and n represents an integer of 1 or 2; at least one color developer selected from the group consisting of gallic acid and phloroglucinol; and a binder and further having provided an overcoat layer on said recording layer, there can be obtained reversible image-forming materials capable of forming images by a thermal head and conversely erasing the formed images by water or moisture. The present inventors have thus accomplished the present invention.

DETAILED DESCRIPTION OF THE INVENTION

The color formers which are employed in the recording layer of the reversible image-forming material in accordance with the present invention are compounds represented by general formulae (I) and (II) described above. Particularly preferred compounds of general formula (I) include the following compounds.

3-Dibutylamino-7-(o-chlorophenylamino)fluorane
3-Dibutylamino-7-(o-fluorophenylamino)fluorane
3-Diethylamino-7-(o-chlorophenylamino)fluorane Further, specific examples of particularly preferred compounds shown by general formula (II) include the following compounds:

3-(N-Methyl-N-phenylamino)-7-aminofluorane
3-(N-Ethyl-N-phenylamino)-7-aminofluorane
3-(N-Propyl-N-phenylamino)-7-aminofluorane
3-[N-Methyl-N-(p-methylphenyl)amino]-7-aminofluorane
3-[N-Ethyl-N-(p-methylphenyl)amino]-7-aminofluorane
3-[N-Propyl-N-(p-methylphenyl)amino]-7-aminofluorane
3-[N-Methyl-N-(p-ethylphenyl)amino]-7-aminofluorane
3-[N-Ethyl-N-(p-ethylphenyl)amino]-7-aminofluorane
3-[N-Propyl-N-(p-ethylphenyl)amino]-7-aminofluorane
3-[N-Methyl-N-(2',4'-dimethylphenyl)amino]-7-aminofluorane
3-[N-Ethyl-N-(2',4'-dimethylphenyl)amino]-7-aminofluorane
3-[N-Propyl-N-(2',4'-dimethylphenyl)amino]-7-aminofluorane
3-[N-Methyl-N-(p-chlorophenyl)amino]-7-aminofluorane
3-[N-Ethyl-N-(p-chlorophenyl)amino]-7-aminofluorane
3-[N-Propyl-N-(p-chlorophenyl)amino]-7-aminofluorane
3-(N-Methyl-N-phenylamino)-7-methylaminofluorane
3-(N-Ethyl-N-phenylamino)-7-methylaminofluorane
3-(N-Propyl-N-phenylamino)-7-methylaminofluorane
3-[N-Methyl-N-(p-methylphenyl)amino]-7-ethylaminofluorane
3-[N-Ethyl-N-(p-methylphenyl)amino]-7-benzylaminofluorane
3-[N-Methyl-N-(2',4'-dimethylphenyl)amino]-7-methylaminofluorane
3-[N-Ethyl-N-(2',4'-dimethylphenyl)amino]-7-ethylaminofluorane
3-[N-Methyl-N-(2',4'-dimethylphenyl)amino]-7-benzylaminofluorane
3-[N-Ethyl-N-(2',4'-dimethylphenyl)amino]-7-benzylaminofluorane
3-(N-Methyl-N-phenylamino)-7-dimethylaminofluorane
3-(N-Ethyl-N-phenylamino)-7-dimethylaminofluorane
3-[N-Methyl-N-(p-methylphenyl)amino]-7-dimethylaminofluorane
3-[N-Ethyl-N-(p-methylphenyl)amino]-7-dimethylaminofluorane
3-(N-Methyl-N-phenylamino)-7-dipropylaminofluorane
3-(N-Ethyl-N-phenylamino)-7-dipropylaminofluorane
3-[N-Methyl-N-(p-methylphenyl)amino]-7-dibenzylaminofluorane
3-[N-Ethyl-N-(p-methylphenyl)amino]-7-dibenzylaminofluorane
3-[N-Methyl-N-(p-methylphenyl)amino]-7-di(p-chlorobenzyl)aminofluorane
3-[N-Ethyl-N-(p-methylphenyl)amino]-7-di(p-methylbenzyl)aminofluorane
3-[N-Methyl-N-(p-methylphenyl)amino]-7-acetylaminofluorane
3-[N-Ethyl-N-(p-methylphenyl)amino]-7-benzoylaminofluorane
3-[N-Methyl-N-(p-methylphenyl)amino]-7-(o-methoxybenzoyl)aminofluorane
3-[N-Ethyl-N-(p-methylphenyl)amino]-7-(o-nitrobenzoyl)aminofluorane
3-[N-Methyl-N-(p-methylphenyl)amino]-6-methyl-7-phenylaminofluorane
3-[N-Ethyl-N-(p-methylphenyl)amino]-6-methyl-7-phenylaminofluorane
3-[N-Methyl-N-(p-methylphenyl)amino]-6-tert-butyl-7-(p-chlorphenyl)aminofluorane
3-[N-Methyl-N-(p-methylphenyl)amino]-6-tert-butyl-7-(p-methylphenyl)aminofluorane
3-(N-Ethyl-N-phenylamino)-6-methyl-7-[N-ethyl-N-(p-methylphenyl)amino]-fluorane
3-[N-Propyl-N-(p-methylphenyl)amino]-6-methyl-7-[N-methyl-N-(p-methylphenyl)amino]-fluorane
3-[N-Ethyl-N-(p-methylphenyl)amino]-5-methyl-7-benzylaminofluorane
3-[N-Methyl-N-(p-methylphenyl)amino]-5-chloro-7-dibenzylaminofluorane
3-[N-Methyl-N-(p-methylphenyl)amino]-5-methoxy-7-dibenzylaminofluorane
3-[N-Ethyl-N-(p-methylphenyl)amino]-6-methylfluorane
3-[N-Ethyl-N-(p-methylphenyl)amino]-7-methylfluorane
3-[N-Ethyl-N-(p-methylphenyl)amino]-5-methoxyfluorane
3-[N-Ethyl-N-(p-methylphenyl)amino]-7-methoxyfluorane
3-[N-Ethyl-N-(p-methylphenyl)amino]-7-chlorofluorane
3-[N-Ethyl-N-(p-methylphenyl)amino]-6,7-dimethylfluorane
3-[N-Ethyl-N-(p-methylphenyl)amino]-6-methyl-7-chlorofluorane
3-[N-Ethyl-N-(p-methylphenyl)amino]-5-tert-butyl-7-methylfluorane
3-[N-Ethyl-N-(p-methylphenyl)amino]-5,6,7-trimethylfluorane
3-[N-Methyl-N-(2',4'-dimethylphenyl)amino]-5,7-dimethyl-6-chlorofluorane In addition to the color formers shown by general formulae (I) and (II) used in the present invention, the following color formers may also be used in combination:

3,3-Bis(4'-dimethylaminophenyl)-6-dimethylaminophthalide
6-Cyclohexylamino-2-methylfluorane
2-Chloro-6-diethylamino-3-methylfluorane
6-Dimethylamino-1,3,4-trimethylfluorane
3-(1-Ethyl-2-methylindol-3-yl)-3-(4-diethylamino-2-butoxyphenyl)phthalide
3,3-Bis(1-ethyl-2-methylindol-3-yl)phthalide
9-Diethylaminospiro(12H-benzo(a)xanthene12,1'(3'H)-isobenzofran-3'-one
6-Dimethylamino-2-dibenzylaminofluorane Isomeric 5-(1-ethyl-2-methylindol-3-yl)-5-(4-dimethylamino-2-ethoxyphenyl)-5,7-dihydrofuro(3,4-b)pyridin-7-one and 7-(1-ethyl-2-methylindol-3-yl)-7-(4-dimethylamino2-ethoxyphenyl)-5,7-dihydrofuro(3,4-b)pyridin-5-one.

The color developer used in the recording layer of the reversible image-forming material in the present invention is phloroglucinol and/or gallic acid.

As the binder used in the recording layer of the reversible image-forming material of the present invention, mention may be made of conventionally used high molecular weight materials which are dissolved in organic solvents. Particularly preferred are hydroxypropyl cellulose, cellulose acetate, ethyl cellulose, etc.

The recording layer which is homogeneous can be obtained by coating a solution prepared by dispersing and dissolving in a solvent three components of the color former, the color developer and the binder, onto a support followed by drying. Any solvent can be employed as long as it dissolves the three components. Examples of such solvents include acetone, methyl ethyl ketone, ethanol, toluene, ethyl acetate, 2-ethoxyethyl acetate, etc.

In addition to the color former, color developer and binder, there may be added tackifiers, white pigments and the like without any limitation. The solution for the recording layer is coated over the entire surface of the support using, for example, a gravure coater, a flexo coater, etc.; alternatively, print-coated onto a part of the support by a gravure printing machine, a flexo printing machine, etc.

The preferable thickness of the recording layer is 1 to 3 μm.

As the support on which the recording layer is provided, there is used, for example, resin-laminated base paper.

Resins used for the resin-laminated base paper are polyethylene, polypropylene, polyisobutylene, ethylenepropylene copolymer, polystyrene, polybutylene, polypentene, polyacrylates, polyvinyl chloride, linear polyesters such as polyethylene terephthalate, polycarbonate, polyamides such as nylon, cellulose esters, copolymers such as ethylenevinyl acetate copolymer, etc. Preferred resins are polyethylene, polypropylene, polyisobutylene, copolymers mainly composed of ethylene or propylene, and mixtures of these polyolefins. Polyethylene is particularly preferred.

Base paper which can be used may be ordinary plain paper.

Particularly preferred resin-laminated based paper is paper laminated with polyethylene resin on one surface or both surfaces thereof.

As the support, transparent resin films may be used. Examples of such transparent resin films include those obtained from polyethylene, polypropylene, polyisobutylene, ethylene-propylene copolymer, polystyrene, polybutylene, polypentene, polyacrylates, polyvinyl chloride, linear polyesters such as polyethylene terephthalate, polyamides such as nylon, polycarbonate, cellulose esters, copolymers such as ethylene-vinyl acetate copolymers. Preferred films are those of polypropylene, polystyrene, polyvinyl chloride and polyethylene terephthalate.

Films obtained by coating white pigments on the back surfaces of the aforesaid transparent resin films or non-transparent resin films may also be used as the supports. Ordinary white pigments may be used but particularly preferred are inorganic pigments such as calcium carbonate, titanium oxide, barium sulfate, magnesium sulfate, calcium sulfate, zinc sulfate, kaolin, activated acid clay, zeolite, bentonite, talc, etc., organic pigments such as polystyrene, polyethylene, urea-formalin resin, etc. The surface of the resin film on the back surface of which the white pigment is coated may be subjected to a corona discharge treatment.

In the reversible image-forming material of the present invention, the overcoat layer is provided on the recording layer described above. The overcoat layer may be composed of a transparent film material which is compatible with the recording layer and, polystyrene resin is particularly preferred. This overcoat layer may be coated on the recording layer in a conventional manner. The preferable thickness of the overcoat layer is 2 to 5 μm.

Occurrence of the sticking phenomenon in high speed printing, which is a defect involved in the reversible heat-sensitive transparent film of Published Unexamined Japanese Patent Application KOKAI No. 191190/83 supra, can be prevented by further providing a sticking prevention layer on the overcoat layer. It is preferred that the sticking prevention layer be composed of three components, pigments, lubricants and binders.

As the pigments contained in the sticking prevention layer, finely divided particles having a particle diameter of several mμ to several thousand mμ such as colloidal silica, colloidal alumina, etc. are preferred. As the lubricants contained in the sticking prevention layer, metal soap type lubricants, aliphatic amide type lubricants, aliphatic hydrocarbon type lubricants, higher aliphatic alcohol type lubricants, higher fatty acid type lubricants, fatty acid ester type lubricants, etc. may be utilized. Of these, metal soap type lubricants such as zinc stearate, calcium stearate and barium stearate are preferred.

As binders for the sticking prevention layer, conventionally used high molecular weight materials which are soluble in organic solvents may be employed. Particularly preferred are binders having excellent heat resistance, for example, ethyl cellulose, cellulose acetate and ethyl hydroxyethyl cellulose.

The sticking prevention layer which is homogeneous can be obtained by coating a solution prepared by dispersing and dissolving in a solvent the three components of pigments, lubricants and binders, onto the overcoat layer followed by drying. As the solvents, mention may be made of aromatic and aliphatic hydrocarbons, halogenated hydrocarbons, alcohols, etc. The solution of these three components in the solvent may be print-coated onto the overcoat layer using, for example, a gravure coater, a gravure printing machine, a flexo coater, a flexo printing machine, etc. The preferable thickness of the sticking prevention layer is 1 to 3 μm.

It is believed that the pigments, lubricants and binders contained in the sticking prevention layer of the reversible image-forming material in accordance with the present invention would act as follows.

The pigments are present between the overcoat layer and the thermal head to prevent both from directly contacting with each other, whereby fusion of overcoat agents to the thermal head is prevented. This hardly affects thermal conduction between the thermal head and the overcoat layer. Further due to the use of finely divided particles, hinding power is small so that seeing-through of the printed images formed on the recording layer is not affected at all.

The incorporation of the lubricants results in increase of the sticking prevention effect and decrease in abrasion of the thermal head.

In addition, the binders in the sticking prevention layer have a function to adhere these pigments and lubricants onto the overcoat layer.

The sticking prevention layer in the reversible image-forming material of the present invention prevents occurrence of the sticking phenomenon but does not affect permeation of water or moisture into the recording layer. Accordingly, the sticking prevention layer is most suitable for the reversible image-forming material which can erase the formed images by water or moisture.

The image formation using the reversible image-forming material of the present invention is effected upon heating. As a recording device, a thermal printer, a thermal recording type facsimile, a heat reflection copying apparatus or the like is used. Erasure of the images is achieved by maintaining the reversible image-forming material in an atmosphere under high humidity or soaking it in water. More specifically, the material on which the images are formed is immersed or soaked in water for several minutes or brought into contact with wet cloth or a wet surface of paper, etc. The formation and erasure of the images can be repeated any times. The image-forming material is maintained in a state in which images are formed or in a state in which images are erased, unless water or moisture, or heat is acted thereon. The background after the formed images are erased is white and has no pattern without any trace of the formed images.

Advantages obtained by the reversible image-forming material of the present invention are as follows.

Firstly, clear images having a high density can be formed.

Secondly, the reversible image-forming material of the present invention can be used repeatedly, and the repeated use contributes to saving resources, contrary to a flood of various recording sheets using thermal heads which are not repeatedly usable.

Thirdly, clear, black-colored or non-black-colored print images of characters having a high density can be obtained on the white background when a resin film coated with white pigments on the back surface thereof or a resin-laminated base paper is used as the support.

Fourthly, the reversible image-forming material can be used as repeatedly usable recording material for overhead projector when a transparent resin film is used as the support.

Fifthly, when the sticking prevention layer is provided, the sticking prevention layer can prevents occurrance of the sticking phenomenon, which enables high speed printing.

Hereafter the present invention will be further described with reference to the examples but is not deemed to be limited thereto. In the examples, "part" is by weight, unless otherwise indicated.

EXAMPLE 1

In 95.0 parts of acetone were dissolved 1.0 part of 3-dibutylamino-7-(o-chlorophenylamino)fluorane, 1.5 parts of phloroglucinol and 2.5 parts of hydroxypropyl cellulose to prepare a solution for the recording layer. The obtained solution was coated onto a polyethylene resin-laminated photographic base paper of 64 g/m$^2$ using a Meyer's bar, which was put in a drier of 60° C. to dry. The dried recording layer was in a black state. Separately, a solution for the overcoat layer was prepared by dissolving 10 parts of polystyrene resin in 90 parts of toluene. The solution for the overcoat layer was coated onto the black-colored recording layer using a Meyer's bar, which was dried in a drier of 60° C. The thus obtained material was still in a black state.

The thus obtained material was maintained for several minutes in a moisture-constant thermostat having a temperature of 40° C. and a humidity of 90% to erase the black state of the recording layer. The background of the thus obtained material was in a white state which showed a color of the photographic base paper itself.

Printing was performed on the thus obtained reversible image-forming material from the surface of the recording layer using Facsimile Tester made by Matsushita Electron Parts Co., Ltd. and, clear, black-colored printed images of characters having a high density could be obtained. Thereafter, the printed images could be erased by water. Again, printing and erasure were repeated in a similar manner, which gave good reproducibility. It could thus be confirmed that the material was extremely excellent as a reversible image-forming material.

EXAMPLE 2

A reversible image-forming material was prepared in a manner similar to Example 1 using as support a polyethylene resin-laminated photographic base paper of 64 g/m$^2$ except that 3-dibutylamino-7-(o-fluorophenylamino)fluorane was used as a color former in place of 3-dibutylamino-7-(o-chlorophenylamino)fluorane in Example 1 and a solution having the following composition was used as the solution for the recording layer.

| | |
|---|---|
| Acetone/ethanol (1:1) solvent mixture | 94.0 parts |
| 3-Dibutylamino-7-(o-fluorophenylamino)fluorane | 0.75 part |
| Phloroglucinol | 1.75 parts |
| Hydroxypropyl cellulose | 3.5 parts |

Using the thus obtained reversible image-forming material, printing and erasure were repeated in a manner similar to Example 1 and, the marked effect was confirmed.

EXAMPLE 3

A reversible image-forming material was prepared by a composition and in a manner similar to Example 1 except that 3-diethylamino-7-(o-chlorophenylamino)-fluorane was used as a color former in place of 3-dibutylamino-7-(o-chlorophenylamino)fluorane in Example 1.

Using the thus obtained reversible image-forming material, printing and erasure were repeated in a manner similar to Example 1 and, the marked effect was confirmed.

COMPARATIVE EXAMPLE 1

A coated paper bearing a black-colored recording layer was obtained in a manner similar to Example 1 except that 3-diethylamino-6-methyl-7-phenylaminofluorane was used as a color former in place of 3-dibutylamino-7-(o-chlorophenylamino)fluorane in Example 1. The thus obtained coated paper was maintained for several minutes in a moisture-constant thermostatt having a temperature of 40° C. and a humidity of 90% and then taken out. The black color of the recording layer was not erased. The material was further maintained under the same condition but no change was noted. Using Facsimile Tester made by Matsushita Electron Parts Co., Ltd., printing was performed on the black-colored coated paper but the background was very black and no color formation other than the black color was noted.

From the foregoing, no effect as any reversible image-forming material was obtained when 3-diethylamino-6-methyl-7-phenylaminofluorane was used as a color former.

EXAMPLE 4

In 93.0 parts of acetone were dissolved 2.0 parts of 3-[N-ethyl-N-(p-methylphenyl)amino]-6-methyl-7-phenylaminofluorane, 2.0 parts of phloroglucinol and 3.0 parts of hydroxypropyl cellulose to prepare a solution for the recording layer. The obtained solution was coated onto a polyethylene resin-laminated photographic base paper of 64 g/m$^2$ using a Meyer's bar, which was put in a dried of 60° C. to dry. The dried recording layer was in a black-colored state. Separately, a solution for the overcoat layer was prepared by dissolving 10 parts of polystyrene resin in 90 parts of toluene. The solution for the overcoat layer was coated onto the black-colored recording layer using a Meyer's bar, which was dried in a drier of 60° C. The thus obtained material was still in a black-colored state.

The thus obtained material was maintained for several minutes in a moisture-constant thermostat having a temperature of 40° C. and a humidity of 90% to erase the black-colored state of the recording layer. The background of the thus obtained material was in a white state which showed a color of the base paper itself.

Printing was performed on the thus obtained reversible image-forming material from the surface of the recording layer using Facsimile Tester made by Matsushita Electron Parts Co., Ltd. and, clear, black-colored printed images of characters having a high density could be obtained. Thereafter, the printed images could be erased by water. Again, printing and erasure were repeated in a similar manner, which gave good reproducibility. It could thus be confirmed that the material was extremely excellent as a reversible image-forming material.

EXAMPLE 5

A reversible image-forming material was prepared in a manner similar to Example 4 except that 3-[N-methyl-N-(p-methylphenyl)amino]-6-methyl-7-phenylaminofluorane was used as a color former in place of 3-[N-ethyl-N-(p-methylphenyl)amino]-6-methyl-7-phenylaminofluorane in Example 4 and a solution having the following composition was used as the solution for the recording layer. The material was likewise in a black-colored state.

| | |
|---|---|
| Acetone/ethanol (1:1) solvent mixture | 96.0 parts |
| 3-[N—methyl-N—(p-methylphenyl) amino]-6-methyl-7-phenylamino-fluorane | 1.0 part |
| Phloroglucinol | 1.0 part |
| Hydroxypropyl cellulose | 2.0 parts |

Using the thus obtained reversible image-forming material, printing and erasure were repeated in a manner similar to Example 4 and, the marked effect was confirmed.

COMPARATIVE EXAMPLE 2

A coated paper bearing a black-colored recording layer was obtained in a manner similar to Example 4 except that 3-diethylamino-6-methyl-7-phenylaminofluorane was used as a color former in place of 3-[N-ethyl-N-(p-methylphenyl)amino]-6-methyl-7-phenylaminofluorane in Example 4. The thus obtained coated paper was maintained for several minutes in a moisture-constant thermostat having a temperature of 40° C. and a humidity of 90% and then taken out. The black color of the recording layer was not erased. The material was further maintained under the same condition but no change was noted. Using Facsimile Tester made by Matsushita Electron Parts Co., Ltd., printing was performed on the black-colored coated paper but the background was very black and no color formation other than the black color was noted.

From the foregoing, no effect as any reversible image-forming material was obtained when 3-diethylamino-6- methyl-7-phenylaminofluorane was used as the color former.

EXAMPLE 6

In 95.0 parts of acetone were dissolved 1.0 part of 3-dibutylamino-7-(o-chlorophenylamino)fluorane, 1.5 parts of phloroglucinol and 2.5 parts of hydroxypropyl cellulose to prepare a solution for the recording layer. The obtained solution was coated onto a polypropylene resin-laminated film of 80 g/m$^2$, on the back surface of which white pigments composed of titanium oxide and calcium carbonate were coated, using a Meyer's bar, which was put in a drier of 60° C. to dry. The dried recording layer was in a black-colored state. Separately, a solution for an overcoat layer was prepared by dissolving 10 parts of polystyrene resin in 90 parts of toluene. The solution for the overcoat layer was coated onto the black recording layer using a Meyer's bar, which was dried in a drier of 60° C. The thus obtained material was still in the black-colored state.

The thus obtained material was maintained for several minutes in a moisture-constant thermostat having a temperature of 40° C. and a humidity of 90% to erase the black-colored state of the recording layer. The background of the thus obtained material was in a white state which showed a color of the base paper itself.

Printing was performed on the thus obtained reversible image-forming material from the surface of the recording layer using Facsimile Tester made by Matsushita Electron Parts Co., Ltd. and, clear, black-colored printed images of characters having a high density could be obtained. Thereafter, the printed images could be erased by water. Again, printing and erasure were repeated in a similar manner, which gave good reproducibility. It could thus be confirmed that the material was extremely excellent as a reversible image-forming material.

EXAMPLE 7

A reversible image-forming material was prepared in a manner similar to Example 6 using as a support a polypropylene resin-laminated film of 80 g/m$^2$, on the back surface of which white pigments composed of titanium oxide and calcium carbonate were coated, except that 3-dibutylamino-7-(o-fluorophenylamino)-fluorane was used as a color former in place of 3-dibutylamino-7-(o-chlorophenylamino)fluorane in Example 6 and a solution having the following composition was used as the solution for the recording layer.

| | |
|---|---|
| Acetone/ethanol (1:1) solvent mixture | 94.0 parts |
| 3-Dibutylamino-7-(o-fluoro-phenylamino)fluorane | 0.75 part |
| Phloroglucinol | 1.75 parts |
| Hydroxypropyl cellulose | 3.5 parts |

This Example is different from Example 2 only in the kind of the support used.

Using the thus obtained reversible image-forming material, printing of characters and erasure were repeated in a manner similar to Example 6 and, the marked effect was confirmed.

EXAMPLE 8

A reversible image-forming material was prepared in a manner similar to Example 6 except that 3-[N-ethyl-N-(p-methylphenyl)amino]-6-methyl-7-phenylamino-fluorane was used as a color former in place of 3-butylamino-7-(o-chlorophenylamino)fluorane in Example 6 and a solution having the following composition was used as the solution for the recording layer and the solution was coated onto a polyethylene terephthalate film, on the back surface of which white pigments composed of calcium carbonate and aluminum hydroxide were coated (the front surface was subjected to a corona discharge treatment).

| | |
|---|---|
| Acetone | 93.0 parts |
| 3-[N—ethyl-N—(p-methyl phenyl)amino]-6-methyl-7-phenylaminofluorane | 2.0 parts |
| Phloroglucinol | 2.0 parts |
| Cellulose acetate | 3.0 parts |

Using the thus obtained reversible image-forming material, printing of characters and erasure were repeated in a manner similar to Example 6 and, the marked effect was confirmed.

COMPARATIVE EXAMPLE 3

In 97.0 parts of acetone were dissolved 0.35 part of crystal violet lactone (3,3-bis(4'-dimethylaminophenyl)-6-dimethylaminophthalide), 1.3 parts of phloroglucinol and 1.35 parts of cellulose acetate to prepare a solution for the recording layer.

Using a Meyer's bar, the thus obtained solution was coated onto a polypropylene film of 80 g/m$^2$, onto the both surfaces of which white pigments composed of titanium oxide and calcium carbonate were coated, and the coated layer was put in a drier of 60° C. to dry it.

The dried recording layer was in a light blue-colored state. Thereafter an overcoat layer was coated thereon in a manner similar to Example 6 to obtain a coated paper having a light blue color. The thus obtained coated paper was maintained for several minutes in a moisture-constant thermostat having a temperature of 40° C. and a humidity of 90% to erase the light blue-colored state of the recording layer. The background of the thus obtained paper was in a white state which showed a color of the support itself.

Using Facsimile Tester made by Matsushita Electron Parts Co., Ltd., printing of characters was performed on the thus obtained coated paper, obtained using the film coated with the white pigments onto both surfaces thereof, from the recording layer side. However, no color formation was noted at all but the white state was maintained as it was. Namely, the material using the film coated with the white pigments onto both surfaces thereof was unsuitable for the purpose of the present invention.

EXAMPLE 9

In 95.0 parts of acetone were dissolved 1.0 part of 3-dibutylamino-7-(o-chlorophenylamino)fluorane, 1.5 parts of phloroglucinol and 2.5 parts of hydroxypropyl cellulose to prepare a solution for the recording layer. The obtained solution was coated onto a polypropylene film of 80 g/m$^2$, onto the back surface of which white pigments composed of titanium oxide and calcium carbonate were coated, using a Meyer's bar, which was put in a drier of 60° C. to dry. The dried recording layer was in a black-colored state. Separately, a solution for an overcoat layer was prepared by dissolving 10 parts of polystyrene resin in 90 parts of toluene. The solution for the overcoat layer was coated onto the previously obtained black-colored recording layer using a Meyer's bar, which was dried in a drier of 60° C. The thus obtained material was still in a black-colored state. Separately, 0.5 part of ethyl cellulose was dissolved in 96.5 parts of toluene. Then, 2.4 parts of colloidal silica (made by Nippon Aerosil Co., Ltd., Aerosil R-972) and 0.6 part of zinc stearate were added to the solution. The mixture was dispersed using a homogenizer. This solution for the sticking prevention layer was coated on the previously obtained overcoat layer using a Meyer's bar, which was dried in a drier of 60° C. The material obtained at this stage was also in a black-colored state.

The thus prepared material was maintained for several minutes in a moisture-constant thermostat having a temperature of 40° C. and a humidity of 90% to erase the black-colored state of the recording layer. The background of the thus obtained material was in a white state which showed a color of the support itself.

High speed printing was performed on the thus obtained reversible image-forming material from the sticking prevention layer side under conditions of a pulse width of 3.0 msec. (2.2 mJ), a sub-scanning direction line density of 3.85 lines/mm and a paper feeding rate of 9.35 mm/sec using Facsimile Tester made by Matsushita Electron Parts Co., Ltd. No sticking phenomenon was observed at all and clear, black-colored printed images of characters having a high density could be obtained. Thereafter the printed images could be erased by water. Again, printing and erasure were repeated in a similar manner, which gave good reproducibility. It could thus be confirmed that the material was extremely excellent as a reversible image-forming material.

EXAMPLE 10

A reversible image-forming material was prepared in a manner similar to Example 9 except that a solution having the following composition was used as the solution for the sticking prevention layer.

| | |
|---|---|
| Chloroform | 96.7 parts |
| Cellulose acetate | 0.5 part |
| Colloidal silica | 2.4 parts |
| Calcium stearate | 0.4 part |

Using the thus obtained reversible image-forming material, printing of characters and erasure were repeated in a manner similar to Example 9 and, the marked effect was confirmed.

EXAMPLE 11

A reversible image-forming material was prepared in a manner similar to Example 9 except that 3-[N-ethyl-N-(p-methylphenyl)amino]-6-methyl-7-phenylaminofluorane was used as a color former in place of 3-dibutylamino-7-(o-chlorophenylamino)fluorane in Example 9 and a solution having the following composition was used as the solution for the recording layer.

| | |
|---|---|
| Acetone | 93.0 parts |
| 3-[N—ethyl-N—(p-methylphenyl)amino]-6-methyl-7-phenylaminofluorane | 2.0 parts |
| Phloroglucinol | 2.0 parts |
| Cellulose acetate | 3.0 parts |

Onto the recording layer, an overcoat layer similar to Example 9 was coated.

Further, a solution for the sticking prevention layer was prepared in the following composition and, the sticking prevention layer was coated in a manner similar to Example 9 to prepare a reversible image-forming material.

| | |
|---|---|
| n-Propanol | 89.98 parts |
| Ethyl cellulose | 0.01 part |
| Colloidal alumina (made by Nissan Kagaku Co., Ltd., 5% aqueous solution of Alumina sol 200) | 10 parts |
| zinc stearate | 0.01 part |

Using the thus obtained reversible image-forming material, printing of characters and erasure were repeated in a manner similar to Example 9 and, the marked effect was confirmed.

EXAMPLE 12

A recording layer and an overcoat layer were coated onto a polypropylene resin film of 80 g/m$^2$, on the back surface of which white pigments composed of titanium oxide and calcium carbonate were coated by a composition and in a manner similar to Example 9. No sticking prevention layer were provided on the overcoat layer. The back-colored state of the recording layer was erased by maintaining the coated material for several minutes in a moisture-constant thermostat having a temperature of 40° C. and a humidity of 90%. The background of the thus obtained material was in a white state which showed a color of the support itself.

Using Facsimile Tester made by Matsushita Electron Parts Co., Ltd., printing was performed at a low speed under conditions of a pulse width of 0.8 msec. (0.74 mJ), a sub-scanning direction line density of 7.7 lines/mm and a paper feeding rate of 1.17 mm/sec. Clear, black-colored printed images of characters having a high density could be obtained. However, high speed printing was performed on the same material under conditions of a pulse width of 3.0 msec. (2.2 mJ), a sub-scanning direction line density of 3.85 lines/mm and a paper feeding rate of 9.35 mm/sec, whereby sticking phenomenon was caused and, missing or incompleteness of the images, stripping of the overcoat layer, adherence of scums onto the thermal head, sticking sound, poor paper feeding, etc. were caused.

EXAMPLE 13

A recording layer and an overcoat layer were coated onto a polypropylene film of 80 g/m$^2$, on the back surface of which white pigments composed of titanium oxide and calcium carbonate were coated by a composition and in a manner similar to Example 9. Separately, 0.5 part of ethyl cellulose was dissolved in 96.5 parts of toluene. Then, 3.0 parts of colloidal silica (made by Nippon Aerosil Co., Ltd., Aerosil R-972) were added to the solution. The mixture was dispersed using a homogenizer. This solution which does not contain a lubricant was coated on the previously obtained overcoat layer using a Meyer's bar to form a sticking prevention layer, which was dried in a drier of 60° C. The material obtained was in a black-colored state and therefore, the black-colored state was erased in a manner similar to Example 9.

Using Facsimile Tester made by Matsushita Electron Parts Co., Ltd., printing was performed at a high speed under conditions of a pulse width of 2.0 msec. (1.48 mJ), a sub-scanning direction line density of 3.85 lines/mm and a paper feeding rate of 9.35 mm/sec. Clear, black-colored printed images of characters having a high density could be obtained. However, high speed printing was performed on the same material under conditions of a pluse width of 3.0 msec. (2.2 mJ), a sub-scanning direction line density of 3.85 lines/mm and a paper feeding rate of 9.35 mm/sec, whereby sticking phenomenon was caused and, missing or incompleteness of the images, stripping of the sticking prevention layer, adherence of scums onto the thermal head, sticking sound, poor paper feeding, etc. were caused. Namely, when the pulse width became long (printing energy became large) under the high speed printing conditions (sub-scanning direction line density of 3.85 lines/mm, a paper feeding rate of 9.35 mm/sec), the sticking phenomenon was caused.

While the invention has been described in detail and with reference to specific embodiments thereof, it will be apparent to one skilled in the art that various changes and modifications can be made therein without departing from the spirit and scope thereof.

What is claimed is:

1. A reversible image-forming material capable of forming images by a thermal head and conversely erasing the formed images by water or moisture which comprises a support having provided on one surface thereof a recording layer comprising at least one color former selected from the group consisting of a fluorane compound represented by general

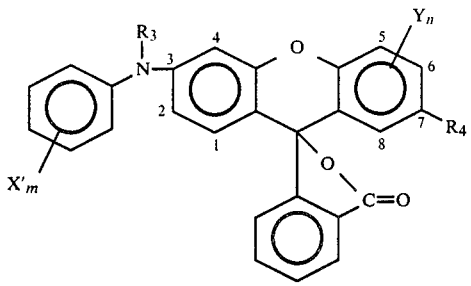

wherein $R_3$ represents a lower aliphatic alkyl group having 1 to 4 carbon atoms; $R_4$ represents a hydrogen atom, an amino group (represented by formula:

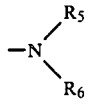

wherein $R_5$ and $R_6$ each represents a hydrogen atom, a lower aliphatic alkyl group having 1 to 4 carbon atoms, a lower aliphatic acyl group having 1 to 4 carbon atoms, a benzoyl group, a phenyl group and a benzyl group; and the benzene rings of these substituents may further be substituted with a halogen atom, a nitro group, a lower aliphatic alkyl group having 1 to 4 carbon atoms and a lower aliphatic alkoxy group having 1 to 2 carbon atoms) and an alicyclic amino group (represented by formula:

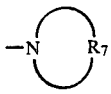

wherein $R_7$ represents a butylene group $-(CH_2)_4-$, a pentylene group $-(CH_2)_5-$ or a diethylene ether group $-(CH_2)_2-O-(CH_2)_2-$); X' represents a hydrogen atom, a lower aliphatic alkyl group having 1 to 4 carbon atoms, a halogen atom or a lower aliphatic alkoxy group having 1 to 4 carbon atoms; m represents an integer of 1 or 2; Y represents a lower aliphatic alkyl group having 1 to 4 carbon atoms, and a lower aliphatic alkoxy group having 1 to 2 carbon atoms; and n represents an integer of 1 or 2; at least one color developer selected from the group consisting of gallic acid and phloroglucinol; and a binder and further having provided an overcoat layer on said recording layer.

2. A reversible image-forming material according to claim 1 wherein said binder is at least one compound selected from the group consisting of hydroxypropyl cellulose, cellulose acetate and ethyl cellulose.

3. A reversible image-forming material according to claim 1 wherein said overcoat layer is polystyrene resin.

4. A reversible image-forming material according to claim 1 wherein said support is resin-laminated base papers.

5. A reversible image-forming material according to claim 4 wherein said support is a support laminated with polyethylene resin on one surface or both surfaces thereof.

6. A reversible image-forming material according to claim 1 wherein said support is a transparent resin film.

7. A reversible image-forming material according to claim 1 wherein said support is a resin film coated with a white pigment onto the back surface thereof.

8. A reversible image-forming material according to claim 1 wherein a sticking prevention layer is provided on said overcoat layer.

9. A reversible image-forming material according to claim 8 wherein said sticking prevention layer comprises a pigment, a lubricant and a binder.

10. A reversible image-forming material according to claim 9 wherein said pigment for said sticking prevention layer is at least one compound selected from the group consisting of colloidal silica and colloidal alumina.

11. A reversible image-forming material according to claim 9 wherein said lubricant for the sticking prevention layer is a metal soap type lubricant.

12. A reversible image-forming material according to claim 9 wherein said binder for the sticking prevention layer is at least one compound selected from the group consisting of ethyl cellulose, cellulose acetate and hydroxyethyl cellulose.

13. A reversible image-forming material according to claim 1 wherein said support is a non-transparent support.

14. A reversible image-forming material capable of forming images by a thermal head and conversely erasing the formed images by water or moisture which comprises a support having provided on one surface thereof a recording layer comprising at least one color former selected from the group consisting of a fluorane compound represented by general formula (II):

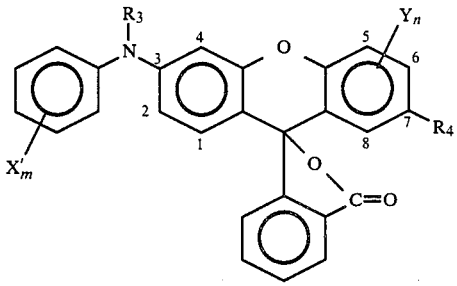

wherein $R_3$ represents a lower aliphatic alkyl group having 1 to 4 carbon atoms; $R_4$ represents a hydrogen atom, methyl group, methoxy group, chloro, an amino group (represented by formula:

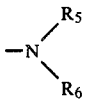

wherein $R_5$ and $R_6$ each represents a hydrogen atom, a lower aliphatic alkyl group having 1 to 4 carbon atoms, a lower aliphatic acyl group having 1 to 4 carbon atoms, a benzoyl group, a phenyl group and a benzyl group; and the benzene rings of these substituents may further be substituted with a halogen atom, a nitro group, a lower aliphatic alkyl group having 1 to 4 carbon atoms and a lower aliphatic alkoxy group having 1 to 2 carbon atoms) and an alicyclic amino group (represented by formula:

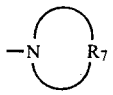

wherein $R_7$ represents a butylene group —$(CH_2)_4$—, a pentylene group —$(CH_2)_5$— or a diethylene ether group —$(CH_2)_2$—O—$(CH_2)_2$—); X' represents a hydrogen atom, a lower aliphatic alkyl group having 1 to 4 carbon atoms, a halogen atom or a lower aliphatic alkoxy group having 1 to 4 carbon atoms; m represents an integer of 1 or 2; Y represents a lower aliphatic alkyl group having 1 to 4 carbon atoms, a lower aliphatic alkoxy group having 1 to 2 carbon atoms, and a halogen atom; and n represents an integer of 1 or 2; at least one color developer selected from the group consisting of gallic acid and phloroglucinol; and a binder and further having provided an overcoat layer on said recording layer.

15. A reversible image-forming material according to claim 14 wherein said color former is at least one compound selected from the group consisting of compounds described below:

3-(N-Methyl-N-phenylamino)-7-aminofluorane
3-(N-Ethyl-N-phenylamino)-7-aminofluorane
3-(N-Propyl-N-phenylamino)-7-aminofluorane
3-[N-Methyl-N-(p-methylphenyl)amino]-7-aminofluorane
3-[N-Ethyl-N-(p-methylphenyl)amino]-7-aminofluorane
3-[N-Propyl-N-(p-methylphenyl)amino]-7-aminofluorane
3-[N-Methyl-N-(p-ethylphenyl)amino]-7-aminofluorane
3-[N-Ethyl-N-(p-ethylphenyl)amino]-7-aminofluorane
3-[N-Propyl-N-(p-ethylphenyl)amino]-7-aminofluorane
3-[N-Methyl-N-(2',4'-dimethylphenyl)amino]-7-aminofluorane
3-[N-Ethyl-N-(2',4'-dimethylphenyl)amino]-7-aminofluorane
3-[N-Propyl-N-(2',4'-dimethylphenyl)amino]-7-aminofluorane
3-[N-Methyl-N-(p-chlorophenyl)amino]-7-aminofluorane
3-[N-Ethyl-N-(p-chlorophenyl)amino]-7-aminofluorane
3-[N-Propyl-N-(p-chlorophenyl)amino]-7-aminofluorane
3-(N-Methyl-N-phenylamino)-7-methylaminofluorane
3-(N-Ethyl-N-phenylamino)-7-methylaminofluorane
3-(N-Propyl-N-phenylamino)-7-methylaminofluorane
3-[N-Methyl-N-(p-methylphenyl)amino]-7-ethylaminofluorane
3-[N-Ethyl-N-(p-methylphenyl)amino]-7-benzylaminofluroane
3-[N-Methyl-N-(2',4'-dimethylphenyl)amino]-7-methylaminofluorane
3-[N-Ethyl-N-(2',4'-dimethylphenyl)amino]-7-ethylaminofluorane
3-[N-Methyl-N-(2',4'-dimethylphenyl)amino]-7-benzylaminofluorane
3-[N-Ethyl-N-(2',4'-dimethylphenyl)amino]-7-benzylaminofluorane
3-(N-Methyl-N-phenylamino)-7-dimethylaminofluorane
3-(N-Ethyl-N-phenylamino)-7-dimethylaminofluorane
3-[N-Methyl-N-(p-methylphenyl)amino]-7-diethylaminofluorane
3-[N-Ethyl-N-(p-methylphenyl)amino]-7-diethylaminofluorane
3-(N-Methyl-N-phenylamino)-7-dipropylaminofluorane
3-(N-Ethyl-N-phenylamino)-7-dipropylaminofluorane
3-[N-Methyl-N-(p-methylphenyl)amino]-7-dibenzylaminofluorane
3-[N-Ethyl-N-(p-methylphenyl)amino]-7-dibenzylaminofluorane
3-[N-Methyl-N-(p-methylphenyl)amino]-7-di(p-chlorobenzyl)aminofluorane
3-[N-Ethyl-N-(p-methylphenyl)amino]-7-di(p-methylbenzyl)aminofluorane
3-[N-Methyl-N-(p-methylphenyl]-7-acetylaminofluorane
3-[N-Ethyl-N-(p-methylphenyl)amino]-7-benzoylaminofluorane
3-[N-Methyl-N-(p-methylphenyl)amino]-7-(o-methoxybenzoyl)aminofluorane
3-[N-Ethyl-N-(p-methylphenyl)amino]-7-(o-nitrobenzoyl)aminofluorane
3-[N-Methyl-N-(p-methylphenyl)amino]-6-methyl-7-phenylaminofluorane
3-[N-Ethyl-N-(p-methylphenyl)amino]-6-methyl-7-phenylaminofluorane
3-[N-Methyl-N-(p-methylphenyl)amino]-6-tertbutyl-7-(p-chlorophenyl)aminofluorane
3-[N-Methyl-N-(p-methylphenyl)amino]-6-tert-butyl-7-(p-methylphenyl)aminofluorane
3-(N-Ethyl-N-phenylamino)-6-methyl-7-[N-ethyl-N-(p-methylphenyl)amino]-fluorane
3-[N-Propyl-N-(p-methylphenyl)amino]-6-methyl-7-[N-methyl-N-(p-methylphenyl)amino]-fluorane
3-[N-Ethyl-N-(p-methylphenyl)amino]-5-methyl-7-benzylaminofluorane
3-[N-Methyl-N-(p-methylphenyl)amino]-5-methoxy-7-di-benzylaminofluorane
3-[N-Ethyl-N-(p-methylphenyl)amino]-6-methylfluorane
3-[N-Ethyl-N-(p-methylphenyl)amino]-7-methylfluorane
3-[N-Ethyl-N-(p-methylphenyl)amino]-5-methoxyfluorane
3-[N-Ethyl-N-(p-methylphenyl)amino]-7-methoxyfluorane
3-[N-Ethyl-N-(p-methylphenyl)amino]-7-chlorofluorane
3-[N-Ethyl-N-(p-methylphenyl)amino]-6,7-dimethylfluorane
3-[N-Ethyl-N-(p-methylphenyl)amino]-6-methyl-7-chlorofluorane
3-[N-Ethyl-N-(p-methylphenyl)amino]-5-tert-butyl-7-methylfluorane
3-[N-Ethyl-N-(p-methylphenyl)amino]-5,6,7-trimethylfluorane.

* * * * *